US008771465B2

(12) United States Patent
Li et al.

(10) Patent No.: US 8,771,465 B2
(45) Date of Patent: Jul. 8, 2014

(54) RAW PAPER

(75) Inventors: Hongfa Li, Liaocheng (CN); Mingxin Song, Liaocheng (CN); Jianmin Wang, Liaocheng (CN); Yanjin Bi, Liaocheng (CN); Jinxiang Xu, Liaocheng (CN); Zhongcheng He, Liaocheng (CN)

(73) Assignee: Shandong Fuyin Paper & Environmental Protection Technology Co., Ltd, Shandong (CN)

( * ) Notice: Subject to any disclaimer, the term of this patent is extended or adjusted under 35 U.S.C. 154(b) by 0 days.

(21) Appl. No.: 13/143,809

(22) PCT Filed: Dec. 9, 2009

(86) PCT No.: PCT/CN2009/075431
§ 371 (c)(1),
(2), (4) Date: Jul. 8, 2011

(87) PCT Pub. No.: WO2010/066195
PCT Pub. Date: Jun. 17, 2010

(65) Prior Publication Data

US 2011/0297343 A1 Dec. 8, 2011

(30) Foreign Application Priority Data

| | | |
|---|---|---|
| Dec. 9, 2008 | (CN) | 2008 2 0180853 U |
| Dec. 9, 2008 | (CN) | 2008 2 0180854 U |
| Dec. 9, 2008 | (CN) | 2008 2 0180855 U |
| Dec. 9, 2008 | (CN) | 2008 2 0180856 U |
| Dec. 9, 2008 | (CN) | 2008 2 0180857 U |
| Dec. 9, 2008 | (CN) | 2008 2 0180858 U |

(51) Int. Cl.

| | |
|---|---|
| ***D21H 11/12*** | (2006.01) |
| ***D21H 27/00*** | (2006.01) |
| ***D21C 5/00*** | (2006.01) |
| *D21C 3/14* | (2006.01) |
| *D21C 9/147* | (2006.01) |
| *D21C 9/02* | (2006.01) |

(52) U.S. Cl.

CPC ..... *D21H 11/12* (2013.01); *D21H 27/00* (2013.01); *D21C 5/00* (2013.01); *D21C 3/14* (2013.01); *D21C 9/147* (2013.01); *D21C 9/02* (2013.01)

USPC ..... 162/100; 162/97; 162/55; 162/65; 162/86; 162/24

(58) Field of Classification Search

CPC ..... D21H 11/12; D21H 27/00; D21H 27/10; D21H 17/63; D21H 21/32; D21C 3/02; D21C 3/14; D21C 3/222; D21C 5/00; D21C 9/147; D21C 9/02

USPC ..... 162/13, 23–24, 29, 55, 56, 60, 63, 65, 162/70, 82–83, 86, 90–91, 97, 141, 162/148–149, 162, 99–100; 241/18, 21; 428/195.1; 8/115.51, 116.1

See application file for complete search history.

(56) References Cited

U.S. PATENT DOCUMENTS

| | | | | | |
|---|---|---|---|---|---|
| 1,347,979 | A | * | 7/1920 | Werner | 162/17 |
| 1,534,236 | A | * | 4/1925 | Adam et al. | 435/278 |
| 2,164,192 | A | * | 6/1939 | Marcham et al. | 162/11 |
| 2,388,592 | A | * | 11/1945 | Asplund et al. | 162/23 |
| 2,662,012 | A | * | 12/1953 | Teunissen | 162/82 |
| 2,686,120 | A | * | 8/1954 | Marshall et al. | 162/14 |
| 4,040,899 | A | * | 8/1977 | Emerson | 162/13 |
| 4,384,920 | A | * | 5/1983 | Markham et al. | 162/19 |
| 5,650,111 | A | * | 7/1997 | Gasland | 264/175 |

(Continued)

FOREIGN PATENT DOCUMENTS

| | | | |
|---|---|---|---|
| CN | 1834345 | A | 9/2006 |
| CN | 1924189 | A | 3/2007 |

(Continued)

OTHER PUBLICATIONS

International Search Report (PCT/ISA/210) issued on Mar. 25, 2010, by Chinese Patent Office as the International Searching Authority for International Application No. PCT/CN2009/075431.

Written Opinion (PCT/ISA/237) issued on Mar. 25, 2010, by Chinese Patent Office as the International Searching Authority for International Application No. PCT/CN2009/075431.

* cited by examiner

*Primary Examiner* — Jose Fortuna

(74) *Attorney, Agent, or Firm* — Buchanan Ingersoll & Rooney PC

(57) ABSTRACT

A raw paper prepared by a mixed pulp including straw pulp, which can be used to prepare textbooks, writing papers and office paper with good performance, and the producing method of said raw paper are provided. The weight proportion of the straw pulp in the mixed stock is from 10% to 100%, and the straw pulp has a hardness of $KMnO_4$ value 10-17, an average fiber length of 0.1-2.5 mm, a tensile index of 23-57 Nm/g, a tearing index of 3.0-6.0 mN·m2/g, a folding endurance index of 2-6 kPa·m2/g and a whiteness of 28-50%. Either, the L value of the hue of said raw paper is 65-95, a value is 0-5, and b value is 0-40. The $KMnO_4$ value of hardness of the pulp after oxygen delignification is 10-14. The method includes: adding grass-series raw material into a digester, then adding cooking liquor, heating the cooking liquor to 100-200°, pressurizing to 0.3-0.9 MPa, cooking for 150-250 min, extruding the pulp, washing and obtaining the straw pulp. The amount of the ammonium sulfite of the cooking reagent is 5-20% of the absolute dry material, and the amount of the sodium hydroxide is 0-15% of the absolute dry material, the liquor ratio is 1:2-15.

5 Claims, No Drawings

(56) References Cited

U.S. PATENT DOCUMENTS

| | | | | |
|---|---|---|---|---|
| 6,923,887 | B2 * | 8/2005 | Pan | 162/6 |
| 2001/0023749 | A1 * | 9/2001 | Nay et al. | 162/21 |
| 2003/0070779 | A1 * | 4/2003 | Bransby | 162/97 |
| 2003/0213568 | A1 * | 11/2003 | Wester et al. | 162/7 |
| 2003/0213569 | A1 * | 11/2003 | Wester et al. | 162/18 |
| 2003/0213570 | A1 * | 11/2003 | Vrbanac et al. | 162/56 |
| 2004/0163779 | A1 * | 8/2004 | Pan | 162/5 |
| 2004/0256065 | A1 * | 12/2004 | Ahmed et al. | 162/26 |
| 2005/0022951 | A1 * | 2/2005 | Eltheimer et al. | 162/65 |
| 2006/0207734 | A1 * | 9/2006 | Day et al. | 162/70 |
| 2009/0090478 | A1 * | 4/2009 | Hollomon et al. | 162/65 |
| 2011/0061825 | A1 * | 3/2011 | Li et al. | 162/13 |
| 2011/0114273 | A1 * | 5/2011 | Yaqoob et al. | 162/23 |
| 2011/0297343 | A1 * | 12/2011 | Li et al. | 162/148 |
| 2012/0325421 | A1 * | 12/2012 | Li et al. | 162/189 |

FOREIGN PATENT DOCUMENTS

| | | | |
|---|---|---|---|
| CN | 201264421 | Y | 7/2009 |
| CN | 201264422 | Y | 7/2009 |
| CN | 201268155 | Y | 7/2009 |
| EP | 2224059 | A1 * | 9/2010 |
| JP | 1036304 | A * | 8/1978 |
| JP | 6-123095 | A | 5/1994 |
| WO | WO 8201019 | A1 * | 4/1982 |
| WO | WO 2009015555 | A1 * | 2/2009 |
| WO | WO 2009015556 | A1 * | 2/2009 |
| WO | WO 2009056017 | A1 * | 5/2009 |
| WO | WO 2010066195 | A1 * | 6/2010 |

RAW PAPER

FIELD OF THE INVENTION

The present invention relates to a base paper (raw paper), which can be made into various processed paper, such as the paper sheet of a textbook, the thin layer of a notebook or wrap paper, the flake structure of household paper or the base layer of office paper. The present invention also relates to a preparation method of the base paper.

BACKGROUND OF THE INVENTION

In the prior art, there exist the problems of stimulation to eyes caused by the whiteness of textbook, notebook and duplicating paper, and the use of a large number of chemicals resulting in environmental pollution.

No other dyes, pigments or dyeware are added into the base paper of the present invention. In most cases, the base paper is not bleached or just lightly bleached, and the resulting base paper per se has a natural yellow color which is beneficial to the vision, so as to achieve the purpose of protecting eyes and preventing myopia. At the same time, by employing 100% of the base paper, the damage of chemicals such as dioxin to humans can be avoided, that is to say, the base paper of the present application is environment-friendly.

SUMMARY OF THE INVENTION

A primary object of the present invention is to provide a base paper;

Another object of the present invention is to provide a preparation method of the base paper.

A further object of the present invention is to provide the use of the base paper in paper production.

In order to achieve the objects mentioned above, the invention takes the following technical scheme:

A base paper, which is made from mixed pulp comprising straw pulp and industry pulp, wherein the weight percent of the straw pulp is 10-100 wt. % of the mixed pulp, preferably 30-90 wt. %, more preferably 40-80 wt. %; the straw pulp has a hardness with potassium permanganate value of 10-17, an average fiber length of 0.1-2.5 mm, a tensile index of 23-57 Nm/g, a tear index of 3.0-6.0 $mN \cdot m^2/g$, and a folding number of 2-6 $kPa \cdot m^2/g$; and the straw pulp has a whiteness of 28-50%, preferably 30-45%, more preferably 25-43%.

A method for preparing the base paper, wherein the method comprises: putting the grass material into a cooker, adding cooking liquor, and then heating the cooking liquor to 100-200°, increasing pressure to 0.3-0.9 MPa, keeping cooking for 150-250 minutes, and obtaining the straw pulp after pressing and washing; and in the cooking liquor, ammonium sulfite is used in an amount of 5-20% of bone dry raw material by weight, sodium hydroxide is used in an amount of 0-15% of the bone dry raw material by weight, and the liquor ratio is 1:2-15.

Preferably, the method comprises: putting the grass material into the cooker, adding cooking liquor, and then heating the cooking liquor to 156-173°, increasing pressure to 0.6-0.75 MPa, keeping cooking for 180-220 minutes, and obtaining the straw pulp after pressing and washing; and in the cooking liquor, ammonium sulfite is used in an amount of 9-15% of the bone dry raw material by weight, sodium hydroxide is used in an amount of 0-8% of the bone dry raw material by weight, and the liquor ratio is 1:6-10.

The method further comprises oxygen delignification after washing, which comprises: pumping the pulp after cooking or washing to an oxygen delignification reaction tower for a reaction of 60-90 minutes and obtaining the straw pulp, wherein, a temperature and a pressure of the pulp is respectively 90-100° and 0.9-1.2 MPa at the inlet of the reaction tower, and 95-105° and 0.2-0.4 MPa at the outlet; and the alkali used in the oxygen delignification is 2-4% of bone dry pulp based on sodium hydroxide, and oxygen is added in an amount of 20-40 kg per ton of bone dry pulp.

The method further comprises oxygen delignification, which comprises: 1) regulating concentration of high-hardness pulp which is obtained after cooking; 2) pumping the high-hardness pulp to an oxygen delignification reaction tower and adding sodium hydroxide and oxygen; 3) the high-hardness pulp being subjected to delignification reaction in the oxygen delignification reaction tower, wherein the concentration of high-hardness pulp refers to regulating the concentration of high-hardness pulp to 8-18%; the oxygen delignification is preferably single stage and carried out in the oxygen delignification reaction tower.

Preferably, during the oxygen delignification, a temperature and a pressure of the pulp is respectively 95-100° and 0.9-1.2 MPa at an inlet of the reaction tower, and 100-105° and 0.2-0.4 MPa at an outlet.

Alkali used in the oxygen delignification is 2-4% of bone dry pulp based on sodium hydroxide, oxygen is added in an amount of 20-40 kg per ton of bone dry pulp; and the straw pulp reacts in the reaction tower for 60-90 min.

Preferably, the pulp is heated to 70° and conveyed to a pulp pipe before the oxygen delignification.

Preferably, a magnesium salt is added in amount of 0.2-1% of the bone dry raw material by weight as a protective agent in the oxygen delignification.

Preferably, a bleacher is added in an amount of 1/10~1/4 the one of the prior art.

The invention has the following advantages:

(1) Textbook made from the base paper of the invention as material can form the yellow vision environment to people without adding other dyes, pigments or colorant, which achieves the purpose of protecting the eyes, prevention and treatment of myopia;

(2) The straw pulp without bleaching in the invention avoids health threats caused by dioxins and other environmental problem;

(3) Products made by the base paper are not added dye, pigment or colorant, and the straw pulp is not need to be bleached, which reduces the cost of manufacturing.

DETAILED DESCRIPTION OF PREFERRED EMBODIMENTS

The following embodiments further illustrates the technical solution of the present invention. It will contribute to understand the advantages and effect of the invention. The embodiments do not limit the scope of protection of the invention, and the scope of protection of the invention is decided by the claims.

Example 1

The present example relates to the preparation method of the straw pulp.

The straw pulp of the present example is obtained after cooking and washing, or obtained after cooking, washing and oxygen delignification.

The cooking of the invention can employ a common cooking method in the prior art, such as ammonium sulfite, sodium hydroxide, anthraquinone-sodium hydroxide, sulfate, or anthraquinone-alkali sodium sulfite cooking methods.

The method preferably comprises: putting the grass material into a cooker, adding cooking liquor to the cooker and heating to 100-200°, increasing pressure to 0.3-0.9 MPa, keeping cooking for 150-250 minutes, and obtaining the straw pulp after pressing and washing. Wherein, in the cooking liquor, the ammonium sulfite is used in an amount of 5-20% of the bone dry raw material by weight, the sodium hydroxide is used in an amount of 0-15% of the bone dry raw material by weight, and the liquor ratio is 1:2-15.

More preferably comprises: putting the grass material into a cooker, adding cooking liquor to the cooker and heating to 156-173°, increasing pressure to 0.6-0.75 MPa, keeping cooking for 180-220 minutes, and obtaining the straw pulp after pressing and washing. Wherein, in the cooking liquor, the ammonium sulfite is used in an amount of 9-15% of the bone dry raw material by weight, the sodium hydroxide is used in an amount of 0-8% of the bone dry raw material by weight, and liquor ratio is 1:6-10.

The oxygen delignification is carried out after washing to get the straw pulp of the invention, and the pulp is obtained.

The oxygen delignification of the present invention comprises: pumping the pulp after cooking or washing to an oxygen delignification reaction tower, in which the temperature and pressure of the pulp is respectively 90-100° and 0.9-1.2 MPa at an inlet of the reaction tower, and 95-105° and 0.2-0.6 MPa at an outlet.

Wherein, alkali is used in the oxygen delignification in an amount of 2-4% of bone dry pulp based on sodium hydroxide, and oxygen is added in an amount of 20-40 kg for every ton of bone dry pulp for keeping reaction for 60-90 min to obtain the straw pulp.

The straw pulp of the invention has a hardness with potassium permanganate number of 10-17, an average fiber length of 0.1-2.5 mm, a tensile index of 23-57 Nm/g, a tear index of 3.0-6.0 mN·m$^2$/g, and a folding number of 2-6 kPa·m$^2$/g.

The straw pulp of the invention has a whiteness of 28-50%, preferably 30-45%, more preferably 25-43%.

The straw pulp of the present example is obtained from one or more of wheat straw, rice straw, cotton stalk, giant reed and reed, preferably wheat straw and rice straw.

The example also relates to a mixture of pulp which contains other industrial paper pulp. The industrial paper pulp comprises one or more of bagasse pulp, wood pulp, cotton pulp, bamboo pulp or secondary fiber.

The secondary fiber is made from recycled waste paper pulp fibers.

The straw pulp has a weight ratio of 10-100% of the mixed pulp, preferably 30-90%, more preferably 40-80%.

Example 2

The present example relates to a straw pulp which is the same as that of example 1 except the following difference: the base paper is made from the straw pulp with content of 100% which has a hardness with potassium permanganate value of 10-17, an average fiber length of 0.1-2.5 mm, a tensile index of 23-57 Nm/g, a tear index of 3.0-6.0 mN·m$^2$/g, a folding number of 2-6 kPa·m$^2$/g.

The present example also relates to an anti-myopia base paper of textbooks which is made from the mixed pulp, wherein, the pages of textbooks with a whiteness of 40-76%, preferably 50~76%, more preferably 60~76% are made from straw pulp without adding dyes, pigments or colorant. Further, the pages have an opacity of 70~100%, preferably 80~99%, more preferably 85~95%.

The present example also relates to a base paper of publications which is made from the mixed pulp, wherein, the base paper refers to the page here. The paper made from the mixed pulp without adding any dye, pigment or colorant has a whiteness of 40-76%, preferably 50~76%, more preferably 60~76%. Further, the page has an opacity of 70~100%, preferably 80~99%, more preferably 85~95%.

Example 3

This example is the same as example 1, except that straw pulp fiber and wood pulp fiber obtained by following method are interweaved each other to form a network structure which makes the page multi porous, rough, has large area of optical joint surface and high opacity.

The preparation method and properties of writing paper are as follows: putting the straw into a cooker, adding cooking liquor to the cooker and heating to 165°, increasing pressure to 0.7 MPa, keeping cooking for 240 minutes, and obtaining the straw pulp after pressing and washing. Wherein, in the cooking liquor, ammonium sulfite is used in an amount of 15% of the bone dry raw material by weight, sodium hydroxide is used in an amount of 5% of the bone dry raw material by weight, and liquor ratio is 1:8. The straw pulp has a hardness with potassium permanganate value of 16, a tensile index of 28 Nm/g, a tear index of 3.9 mN·m$^2$/g, a folding number of 3.4 kPa·m$^2$/g, and a whiteness of 35%. The straw pulp and wood pulp are mixed to make the writing paper (base paper) with dirt count of 75/·m$^2$ per 0.3-1.5 mm$^2$, opacity of 91%, whiteness of 51%.

The preparation method and properties of food wrap paper are as follows: putting the straw into a cooker, adding cooking liquor to the cooker and heating to 160°, increasing pressure to 0.65 MPa, keeping cooking for 200 minutes, and obtaining the straw pulp after pressing and washing. Wherein, in the cooking liquor, ammonium sulfite is used in an amount of 10% of the bone dry raw material by weight, sodium hydroxide is used in an amount of 5% of the bone dry raw material by weight, and liquor ratio is 1:8. The straw pulp has a hardness with potassium permanganate value of 16, a tensile index of 38 Nm/g, a tear index of 4.8 mN·m$^2$/g, a folding number of 4.6 kPa·m$^2$/g, a whiteness of 35%. The pulp is used to make the food wrap paper (base paper) with dirt count of 120/·m$^2$ per 0.3-2.0 mm$^2$, bursting strength of 75 kPa, and whiteness of 28-60%.

The dirt count of the invention is measured by the testing method of national standard GB/T 1541-1989 (Paper and board-Determination of dirt).

Example 4

The straw pulp fiber of the invention is defined as the straw pulp fiber which is obtained by the method of the prior art, such as cooking and washing, or cooking, washing and oxygen delignification. The cooking of the invention comprises, but not limited to, ammonium sulfite and alkaline method. The alkaline method comprises anthraquinone-sodium hydroxide, sulfate or basic sodium sulfite cooking methods.

The preferable cooking method of the present example is as follows: putting the straw material into a cooker, adding cooking liquor to the cooker and then heating to 100-200°, increasing pressure to 0.3-0.9 MPa, and keeping cooking for 150-250 minutes, and obtaining the straw pulp after pressing and washing. Wherein, in the cooking liquor, ammonium sulfite is used in an amount of 5-20% of the bone dry raw material by weight, sodium hydroxide is used in an amount of 0-15% of the bone dry raw material by weight, and liquor ratio is 1:2-15.

An oxygen delignification can be carried out after cooking or washing, wherein the oxygen delignification comprises:

1) regulating concentration of high-hardness pulp obtained after cooking;
2) pumping the high-hardness pulp to an oxygen delignification reaction tower and adding sodium hydroxide and oxygen;
3) carrying out delignification reaction in the oxygen delignification reaction tower.

Wherein, the concentration of high-hardness pulp is regulated to 8-18%. In other words, the oxygen delignification is carried out under a high concentration.

Preferably, the oxygen delignification is single stage and executed in the oxygen delignification reaction tower, in which, the temperature and pressure of the pulp is respectively 95-100° and 0.9-1.2 MPa at an inlet of the reaction tower, and 100-105° and 0.2-0.4 MPa at an outlet.

Wherein, alkali used in the oxygen delignification treatment is 2-4% of bone dry pulp based on sodium hydroxide, and oxygen is added in an amount of 20-40 kg for every ton of bone dry pulp; and the straw pulp reacts in the reaction tower for 60-90 min.

Preferably, the pulp is heated to 70° and conveyed to a pulp pipe before the oxygen delignification.

Preferably, magnesium salt with amount of 0.2-1% of the bone dry raw material by weight is added as protective agent.

Preferably, high-hardness of the pulp obtained after the oxygen delignification is potassium permanganate value of 10-14, which is equivalent to 13-19.8 Kappa number, more preferably potassium permanganate value of 11-13, which is equivalent to 14.5-17.9 Kappa number.

The straw pulp of the present example is obtained from one or more of wheat straw, rice straw, cotton stalk, giant reed and reed, preferably wheat straw and rice straw.

The example also relates to a mixture of pulp which contains other industrial paper pulp, wherein the industrial paper pulp comprises one or more of bagasse pulp, wood pulp, cotton pulp, bamboo pulp or secondary fiber which is made from recycled waste paper pulp fibers.

Wherein the straw fiber preferably has a ratio of 10~100 wt. %, more preferably 30~97%, further preferably 51~95%, most preferably 71~93%.

The household paper of the present example can be prepared only by straw pulp fibers or by straw pulp fibers with other plant pulp fiber, such as wood pulp fiber, bamboo pulp fiber and so on.

The base paper of household paper has a tensile index of 1.5~4 N·m/g, preferably 2~3.5 N·m/g, more preferably 2.3~3.2 N·m/g, and the visible dust of 0.3 $mm_2$~2.0 $mm^2$ is 10~500/$m^2$, preferably 20~400/$m^2$, more preferably 30~250/$m^2$, and the visible hole of 2~5 mm on the household paper is 2~100, preferably 5~80, more preferably 20~60.

The dust and hole of the present example are all meet with the national standard definition, such as GB/T20808-2006. The base paper of the household paper of the present example has a basis weight of 10~70 g/$m^2$, preferably 15~50 g/$m^2$, more preferably 20~40 g/$m^2$. The color of the base paper is same as that of the straw pulp fiber and other plant pulp fiber themselves. The household paper of the invention refers to toilet paper, towel paper, wiping paper or tissue paper. Following is the specific embodiments:

A flake tissue paper, which is made up by one base layer manufactured by 50% straw pulp fibers and 50% of the unbleached wood pulp fibers, wherein the base paper has an basis weight of 10 g/$m^2$, a whiteness of 45%, the color of the base paper is the color of the straw fiber and wood pulp fiber themselves, and the base paper has a tensile index of 1.5 N·m/g, particulate matter of 0.3 $mm^2$~2.0 $mm^2$ of less than 50 per square meter, and holes of 2~5 mm of 3~10.

A flake tissue paper, which is composed by three base layers manufactured by 100% of the straw pulp fibers, wherein the base layer has an basis weight of 70 g/$m^2$, a tensile index of 4 N·m/g, a whiteness of 35%, particulate matter of 0.3 $mm^2$~2.0 $mm^2$ of less than 400-500 per square meter, holes of 2~5 mm of 50~100, and the color of the paper is the color of the straw fiber itself.

A flake towel paper, which is composed by two base layers manufactured by 30% of the straw pulp fibers and 70% of the wood pulp fibers, wherein the base layer has a basis weight of 15 g/$m^2$, a tensile index of 2 N·m/g, a whiteness of 55-70%, particulate matter of 0.3 $mm^2$~2.0 $mm^2$ of less than 20 per square meter, and holes of 2~5 mm of 70~90, and the color of the paper is the color of the straw fiber and wood pulp fiber themselves.

A flake wiping paper, which is composed by four base layers manufactured by 60% of the straw pulp fibers and 40% of the wood pulp fibers, wherein the base layer has an basis weight of 50 g/$m^2$, a tensile index of 3.5 N·m/g, a whiteness of 40%, particulate matter of 0.3 $mm^2$~2.0 $mm^2$ of less than 300 per square meter, and holes of 2~5 mm of 30~50, and the color of the paper is the color of the straw fiber and wood pulp fiber themselves.

A drum toilet paper, which is composed by three base layers manufactured by 80% of the straw pulp fibers and 20% of the wood pulp fibers, wherein the base layer has an basis weight of 20 g/$m^2$, a tensile index of 2.5 N·m/g, a whiteness of 38-40%, particulate matter of 0.3 $mm^2$~2.0 $mm^2$ of less than 450 per square meter, and holes of 2~5 mm of 10~20, and the color of the paper is the color of the straw fiber and wood pulp fiber themselves.

A flake toilet paper made into long strip and folded, which is composed by two base layers manufactured by 10% of the straw pulp fibers and 90% of the bleached wood pulp fibers, wherein the base layer has a basis weight of 30-40 g/$m^2$, a tensile index of 3-3.2 N·m/g, a whiteness of 65-75%, particulate matter of 0.3 $mm^2$~2.0 $mm^2$ of less than 20 per square meter, and holes of 2~5 mm of 3~15.

Example 5

This example is the same as example 4 except that, the composite layer of the office paper has a breaking length of 1.5~5 km, preferably 2~4.5 km, more preferably 2.5~4 km, an opacity of 70~100%, preferably 80~99%, more preferably 85~95%, a visible dust of 0.3 $mm^2$~2.0 $mm^2$ of 10~500/$m^2$, preferably 20~400/$m^2$, more preferably 30~250/$m^2$, a whiteness of 35~75%, preferably 35~65%, more preferably 40~60%, a basis weight of 20~160 g/$m^2$, preferably 30~80 g/$m^2$, more preferably 40~70 g/$m^2$, wherein, the base layer of the office paper has a Hue L values of 65-95, preferably 70-94, more preferably 80-91, a value of 0-5, preferably 0-4.5, more preferably 0-3, and b value of 0-40, preferably 0-35, more preferably 0-30.

At least one side of the base layer of office paper is coated by adhesive layer. It means that one side or both two sides can be coated by adhesive layer. The adhesive layer can be set by the method of the prior art, such as taking one or more of starch, animals glue and polyolefin to set adhesive layer, for example, using oxidized starch, polyacrylamide, polyethylene-maleic anhydride polymers, acrylic latex, modified polyvinyl alcohol, sodium carboxymethyl cellulose or styreneacrylate and so on, wherein, the method of prior art comprises press sizing, tube sizing, off-machine sizing, spray sizing, roller press sizing or calendar sizing, wherein the amount of adhesive can be same as that of the prior art, preferably 1~20 kg per ton of paper, more preferably 5~15 kg per ton of paper, most preferably 7~12 kg per ton of paper, wherein, the specific embodiments are as follows:

A flake offset printing paper has a basis weight of 20~50 g/m$^2$, a breaking length of 1.5~2.5 km, a particulate matter of 0.3 mm$^2$~2.0 mm$^2$ of less than 300 per square meter, and an opacity of 100%, width of 10 cm, and length of 38 cm, which comprises a base layer manufactured by 50% of the straw pulp fibers and 50% of the unbleached wood pulp, wherein, both sides of the base layer are coated with adhesive, and the base layer has a whiteness of 45-50%, Hue L values of 50-89, a value of 0-2 and b value of 0-20.

A flake writing paper has a particulate matter of 0.3 mm$^2$~2.0 mm$^2$ of less than 500 per square meter and an opacity of 95%, which comprises a base layer manufactured by 100% of the straw pulp fibers, wherein, the base layer has a whiteness of 35-45%, one side of the base layer is coated with adhesive, and the color of the base layer is the color of straw fiber itself.

A flake writing paper has a particulate matter of 0.3 mm$^2$~2.0 mm$^2$ of less than 200 per square meter and an opacity of 80%, which comprises a base layer manufactured by 60% of the straw pulp fibers and 40% of the unbleached wood pulp fibers, wherein, the base layer has a whiteness of 40%, Hue L values of 65-75, a value of 2.5-3 and b value of 20-35.

A typing paper has a particulate matter of 0.3 mm$^2$~2.0 mm$^2$ of less than 450 per square meter, an opacity of 92% and width of 10 cm, length of 20 cm, wherein, the middle base layer is manufactured by 80% of the straw pulp fibers and 20% of the wood pulp fibers, which has a whiteness of 38-45%, Hue L values of 70-80, a value of 3.5-5, and b value of 30-35, wherein, two surface of the base layer are coated by adhesive layer of modified PVA, with the adhesive used of 10 kg per ton of paper.

A sheet typing paper with a particulate matter of 0.3 mm$^2$~2.0 mm$^2$ of less than 20 per square meter, and an opacity of 94%, which comprises a base layer manufactured by 10% of the straw pulp fibers and 90% of the wood pulp fibers, wherein, the base layer has a whiteness of 55-65%.

The base paper of office paper in the present invention is manufactured by straw pulp fibers and/or other plant pulp fibers, wherein the manufacturing refers to any manufacturing in the prior art, for example, mixing the straw pulp and other plant pulp after beating respectively, or mixing the straw pulp and other plant pulp before beating, which makes the straw fiber and other plant pulp fiber has a certain space structure, such as the space structure of the prior art.

The office paper refers to electrostatic copy paper, writing paper, offset printing paper or typing paper.

Example 6

This example is the same as example 4 and example 5 except that steps of cooking, washing and bleaching with small amount of bleacher can be carried out, wherein the bleacher with a small amount used in the present invention is 1/10~1/4 of the prior art. The base paper made by the straw pulp fiber obtained after oxygen delignification or bleaching with small amount of bleacher can be made into household paper and office paper.

The special embodiment is as follows: an electrostatic copy paper with a basis weight of 130~160 g/m$^2$, a breaking length of 2~4.5 km, a particulate matter of 0.3 mm$_2$~2.0 mm$^2$ of less than 20 per square meter, and an opacity of 92%, which comprises a base layer made by 30% straw fiber and 70% bleached wood pulp fiber, wherein the straw fiber is obtained after cooking, washing and bleaching with a small amount of 1/4 of the prior art of bleacher, wherein both sides of the base layer are coated with adhesive, and the base layer has a whiteness of 65~75%, Hue L values of 55-80, a value of 1.5-5, and b value of 9-35. Wherein, the electrostatic copy paper of the invention has a sizing of polyacrylamide.

The invention claimed is:

1. A base paper, comprising: a Hue L* value of 65-95, a* value of 0-5 and b* value of 0-40, wherein the base paper is made from a pulp consisting of a straw pulp, wherein the straw pulp has a hardness with potassium permanganate value of 10-17, an average fiber length of 0.1-2.5 mm, a tensile index of 23-57 Nm/g, a tear index of 3.0-6.0 mN·m$^2$/g, a folding number of 2-6 kPa·m$^2$/g; and a whiteness of 28-50%.

2. The base paper according to claim 1, wherein the base paper has a Hue L* values of 70-94, a* value of 0-4.5 and b* value of 0-35.

3. The base paper according to claim 2, wherein the base paper has a Hue L* values of 80-91, a* value of 0-3 and b* value of 0-30.

4. The base paper according to claim 1, wherein the straw pulp has a whiteness of 30-45%.

5. The base paper according to claim 4, wherein the straw pulp has a whiteness of 25-43%.

* * * * *